US007457573B2

(12) United States Patent
Tsujita

(10) Patent No.: US 7,457,573 B2
(45) Date of Patent: Nov. 25, 2008

(54) IMAGE FORMING DEVICE HAVING A CONDUCTIVE MEMBER WITH SEPARATION NEEDLES

(75) Inventor: Mitsuji Tsujita, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 374 days.

(21) Appl. No.: 11/164,590

(22) Filed: Nov. 30, 2005

(65) Prior Publication Data

US 2006/0198668 A1 Sep. 7, 2006

(30) Foreign Application Priority Data

Nov. 30, 2004 (JP) ..... 2004-347045

(51) Int. Cl.
*G03G 15/16* (2006.01)

(52) U.S. Cl. ..... 399/315

(58) Field of Classification Search ..... 399/125, 399/315, 316, 323, 398
See application file for complete search history.

(56) References Cited

U.S. PATENT DOCUMENTS 4,739,363 A * 4/1988 Hoshika et al. ..... 399/315
5,345,295 A * 9/1994 Takano et al. ..... 399/125
5,633,703 A * 5/1997 Takenouchi et al. ..... 399/315
5,926,683 A * 7/1999 Yuminamochi et al. ..... 399/398
2003/0124446 A1* 7/2003 Nakanishi et al. ..... 430/106.2
2004/0170453 A1* 9/2004 Ito et al. ..... 399/315
2005/0201789 A1* 9/2005 Yuminamochi ..... 399/390

FOREIGN PATENT DOCUMENTS

JP 7/40158 B2 5/1995
JP 8/137358 A 5/1996
JP 9/218623 A 8/1997

* cited by examiner

*Primary Examiner*—David M. Gray
*Assistant Examiner*—Andrew V Do
(74) *Attorney, Agent, or Firm*—Global IP Counselors, LLP

(57) ABSTRACT

A plurality of separation needles are arranged downstream from a transfer roller in the sheet transport direction along a direction which is orthogonal to the sheet transport direction, and when a separation voltage is applied to the separation needles, an electrical discharge occurs between the photosensitive drum and the separation needles, and a sheet which has been charged by the transfer roller has static charge eliminated and is separated from the photosensitive drum. Furthermore, a transport unit established downstream from the separation needles in the sheet transport direction has a plurality of transport plates which guide the transport of the sheet, and a grounding plate which is located between these transport plates, and the grounding plate is connected to the grounding unit of the device body such that the grounding plate can be seen without interference from the tip end of the separation needles.

8 Claims, 10 Drawing Sheets

| | Comparative Example 1 | | | Comparative Example 2 | | | Embodiment | | | | | | Comparative Example 3 | | | | |
|---|---|---|---|---|---|---|---|---|---|---|---|---|---|---|---|---|---|
| Grounding Plate | No | | | Yes (with interference) | | | Yes | | | | | | Yes | | | | |
| W1 | 3 | 4 | 6 | 3 | 4 | 6 | 2 | 4 | 7 | 7 | 2 | 5 | 1.5 | 3 | 4 | 8 | 8 |
| W2 | 3 | 3 | 2 | 3 | 3 | 2 | 2 | 2 | 2 | 4 | 4 | 3 | 3 | 1 | 1 | 3 | 5 |
| A | 0.5 | 0.5 | 0.5 | 0.5 | 0.5 | 0.5 | 0.5 | 0.5 | 0.5 | 1 | 1 | 0.8 | 0.5 | 0.5 | 0.5 | 0.5 | 0.5 |
| Safety | + | + | + | + | + | + | + | + | + | + | + | + | + | + | + | + | + |
| Separation | − | − | − | − | − | − | + | ++ | + | + | + | ++ | +/− | + | + | +/− | +/− |
| Dielectric Breakdown | − | − | − | − | − | − | + | + | + | + | + | + | +/− | +/− | +/− | + | + |
| Electrostatic scattering | − | − | − | − | − | + | + | + | + | + | + | + | + | + | + | + | + |

( Units: mm )

*Fig. 7*

*Fig. 8* *(Prior Art)*

IMAGE FORMING DEVICE HAVING A CONDUCTIVE MEMBER WITH SEPARATION NEEDLES

BACKGROUND OF THE INVENTION

1. Field of the Invention

The present invention relates to an image forming device such as a copier, printer, or fax machine, and in further detail relates to an image forming device which can easily eliminate static electricity and separate a sheet like recording medium, onto which a toner image has been transferred, from an image supporter.

2. Background Information

Generally, in image forming devices such as electrophotographic copiers, printers, and fax machines, a toner image is formed or transferred to an image supporter such as a photosensitive drum or an intermediate transfer medium, and then the toner image which has been formed or transferred to the surface of the image supporter is transferred to a sheet like recording medium (such as copy paper or a plastic film). Next, this recording medium is separated from the surface of the image supporter by separating means, and then the recording medium which has been separated is sent to fixing means. Furthermore, after the toner image has been fixed on the recording medium by the fixing means, the fixed recording medium is transported to a discharge tray or an intermediate tray for double sided printing.

The discharge separation system shown in FIG. 8 (Refer to Japanese Patent H09-218623 (Patent Reference 1)), the discharge separation system shown in FIG. 9 (Refer to Japanese Patent H08-137358 (Patent Reference 2)), and the discharge separation system shown in FIG. 10 (Refer to Japanese Patent H07-40158 (Patent Reference 3)) are commonly known separating means for this type of image forming device. Of these systems, the separating means 100, 101 shown in FIG. 8 and FIG. 9 have a plurality of separation needles 102, 103 which are supported by an upstream wall region 104, 105 located upstream in the recording medium transport direction, and by a downstream wall region 106, 107 located downstream in the recording medium transport direction. Furthermore, the plurality of separation needles 102, 103 are positioned in a direction orthogonal to the recording medium transport direction (Hereinafter referred to as the paper transport lateral direction). Furthermore, the separating means 108 shown in FIG. 10 has a separation needle 110 with a plurality of discharge tips 110*a* at prescribed intervals along the longitudinal direction of the image supporter 114 located downstream in the sheet transport direction of the transfer charger 109 which is located across from the image supporter 114, and when an electrical charge is applied to the separation needle 110, a discharging current from the separation needle 110 will flow so that the recording medium 112 will separate from the image supporter 114.

With the separating means 100 disclosed in Patent Reference 1, a separating voltage is applied to the separation needle 102 at prescribed timing after the toner image has been transferred to the recording medium 111. Therefore, corona discharge will occur between the separation needle 102 and the image supporter 113, and the static electricity charged on to the recording medium 111 during the copying operation can be discharged by a transfer roller 117. Therefore, the recording medium 111 will separate from the image supporter 113 because of the stiffness and weight of the recording medium.

Furthermore, with the separating means 101 disclosed in Patent Reference 2, excess static charge is discharged from the back side of the recording medium 115 to a grounded separation needle 103, and the static electricity charged to the recording medium by the transfer roller 120 during the transfer operation will be eliminated. Even if this separation means 101 is used, static elimination and separation of the recording medium and the image supporter will be possible if the recording medium is stiff.

Furthermore, with the separating means 108 disclosed in Patent Reference 3, the recording medium 112 will separate from the image supporter 114 after the toner image on the image supporter 114 has been transferred to the recording medium 112. As a condition for separation at this time, when a prescribed voltage is applied to the separation needle 110 and the separation needle 110 and the image supporter 114 are placed at a prescribed interval, the surrounding impedance will change when a transfer corona is generated by the transfer charger 109, a discharge current from the separation needle 110 will be observed, and the recording medium 112 will be separated from the image supporter 114.

Incidentally, in recent years, printing on both sides of the recording medium has become more common for the purpose of effectively using natural resources or the like. When double sided printing is performed on the recording medium in this manner, the recording medium 115 may not readily separate from the image supporter 116 when using the conventional separating means 101 disclosed in Patent Reference 2. Therefore the following measures are taken when printing on both sides of the recording medium 115. The first measure is to first print on one side of the recording medium 115, then use a two sided printing unit or the like to invert the front and back sides of the recording medium 115 which has been printed on one side, and then continue printing on the unprinted side of the recording medium 115. The other measure is to reuse copy paper or the like which has been printed on one side as the recording medium, and then printing on the unprinted side of the recording medium 115 to be reused.

When double sided printing is performed as described above, the curl of the recording medium 115 such as copy paper will tend to be larger than when the recording medium 115 is printed only on one side. At this time, if the curl of the recording medium 115 is able to readily wrap around the side of the image supporter 116 such as a photosensitive drum, or in other words, if the curl is towards the image supporter 116 side, as the curl increases, separating the recording medium from the image supporter 116 will become that much more difficult, the recording medium will wrap around to the image supporter 116 side, and there is a possibility of problems such as paper jams or the like.

In order to relieve these types of problems, with the separating means 100, 108 of Patent Reference 1 and Patent Reference 3 for example, static elimination of the recording medium 111, 112 by applying a voltage which has reverse polarity to the transfer current to the separation needles 102, 110 and causing corona discharging between the separation needle 102, 110 and the image supporter 113, 114 is effective for increasing the efficiency of separating the recording medium 111, 112 from the image supporter 113, 114.

However, with the separating means 100 of Patent Reference 1, if the upstream side wall region 104 and the downstream side wall region 106 are formed from an insulating plastic, the upstream side wall region 104 and the downstream side wall region 106 which are made from insulating plastic will become charged by the corona discharge generated between the separation needle 102 and the image supporter 113, and the electric field (electric field in the paper transport lateral direction) around the plurality of separation needles 102 may be inconsistent depending on the location in the paper transport lateral direction. At this time, if the voltage applied to the separation needle 102 is increased in order to obtain the desired separation properties of the recording medium 111, an abnormal discharge may occur between the separation needle 102 and the image supporter 113, and there is a possibility that dielectric breakdown will occur in the image supporter 113 such as a photosensitive drum.

Similarly, with the separating means 108 of Patent Reference 3, the gap or the like between the separation needle 110 and the image supporter 114 is set to a prescribed value in order to discharge current, and therefore the gap between the separation needle 110 and the image supporter 114 must be precisely set because the separating conditions will vary depending on the value of the voltage applied to the transfer charger 109 and the separation needle 110. Furthermore, if the separation voltage is increased in order to prevent poor separation of the recording medium, there is a possibility that dielectric breakdown to the photosensitive drum will occur if an amorphous silicon (A-Si) photosensitive drum is used, thus causing image defects.

Therefore, the present invention provides an image forming device which can reduce the discharge voltage by increasing the discharge efficiency of the separating means, make the discharge of the separating means uniform in the paper transport lateral direction, prevent dielectric breakdown of the image supporter, and enable good separation of the recording medium from the image supporter.

SUMMARY OF THE INVENTION

The image forming device according to a first aspect of the present invention is comprising an image supporter, supply unit, transferring means, and separating means. The image supporter supports a toner image and rotates. The supply unit supplies a sheet like recording medium to the image supporter. The transferring means transfers the toner image onto the sheet like recording medium transported by the supply unit. The separating means is located downstream from the transferring means in the recording medium transport direction, has a plurality of separation needles located along the direction orthogonal to the recording medium transport direction, and eliminates static electricity from the recording medium by applying a separation voltage to the separation needles in order to separate the recording medium from the image supporter. Furthermore, the separating means is established downstream from the separation needles in the recording medium transport direction, and include a transport unit which transports the recording medium. The transport unit is positioned in a direction orthogonal to the recording medium transport direction, has a plurality of transport plates which guide the transport of the recording medium and a conductive member positioned between the plurality of transport plates, and the conductive member is grounded and visible without interference from the tip end of the separation needles.

The image forming device according to a second aspect of the present invention is the image forming device according to the first aspect, wherein the distance W1 (mm) between the plurality of separation needles is such that $7 \geqq W1 \geqq 2$.Furthermore, ribs for guiding the transport of the recording medium in order to prevent the recording medium from catching on the separation needles is further provided between the plurality of separation needles. Furthermore, the minimum distance W2 (mm) between the ribs and the separation needles is such that $4 \geqq W2 \geqq 2$.

The image forming device according to a third aspect of the present invention is the image forming device according to the first aspect, wherein the image supporter is formed from amorphous silicon.

The present invention has a plurality of transport plates arranged in a direction orthogonal to the direction of recording medium transport which guide the transport of the recording medium, and a conductive member located between the plurality of transport plates. By connecting this conductive member to the ground of the device body in a manner such that the conductive member can easily be seen without interference, corona discharge between the separation needles and the image supporter can be made to easily occur by means of the conductive member, the discharge efficiency of the separating means can be increased, and the discharge voltage can be decreased, thus acting to stabilize the discharge. Furthermore, a drop in image quality (black dots) which occurs in conjunction with dielectric breakdown of the image supporter can be prevented because the discharge voltage can be decreased.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure:

FIG. 7 is a table showing test results.

DETAILED DESCRIPTION OF THE PREFERRED EMBODIMENTS

Embodiments of the present invention will be described below with reference to the figures.

Structure of Image Forming Device

Figure 1:
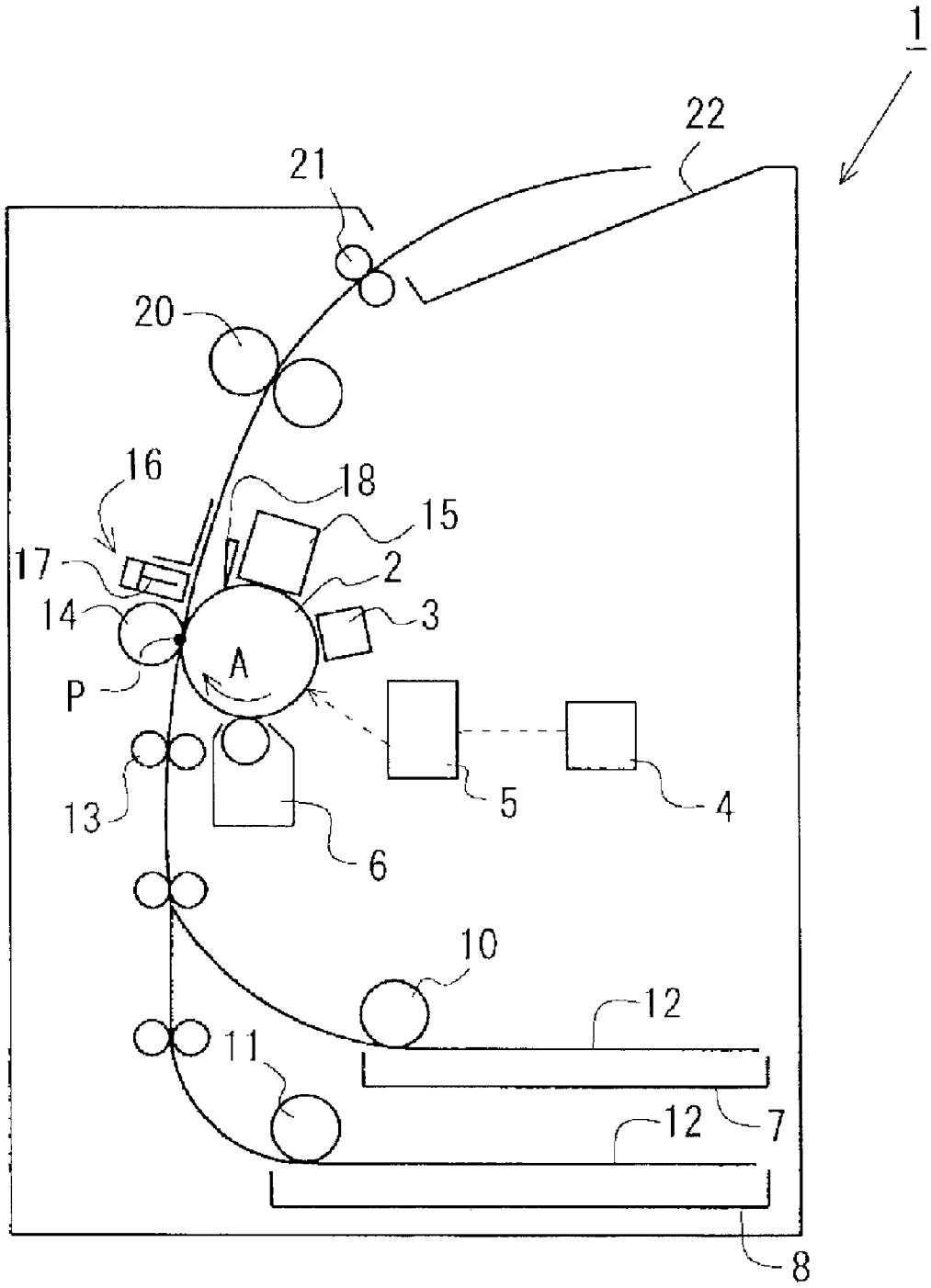
FIG. 1 is a schematic block diagram of the image forming device of an embodiment of the present invention.

FIG. 1 shows the schematic construction of an image forming device 1 according to the present embodiment. In FIG. 1, the photosensitive drum (image supporter) 2 rotates in the direction of arrow A in the figure, and the surface is uniformly charged by charging means 3. In this condition, laser light is irradiated onto the surface of the photosensitive drum by an exposing means 5 which moves based on a control signal from a controlling means 4, and a static electric latent image is formed on the surface thereof. Next, toner is supplied as a developing agent by a developing means 6 onto the surface of the photosensitive drum 2, and the static electric latent image becomes visible as a toner image.

On the other hand, a sheet like recording medium 12 (such as copy paper, plastic film, or the like, hereinafter simply referred to as the sheet) fed from the paper supply trays 7, 8 by the paper supply rollers 10, 11, is fed into a transfer position P between the photosensitive drum 2 and the transfer roller (transferring means) 14 by a supply unit which includes a resist roller 13 and the like. The transfer roller 14 transfers the toner image which has adhered to the surface of the photosensitive drum 2 to a sheet 12 at a transfer location P (nip region of the photosensitive drum 2 and the transfer roller 14) by applying a transfer bias with polarity inverse from that of the toner to the sheet 12. Note, toner which is not transferred to the sheet 12 and remains on the surface of the photosensitive drum is removed using a cleaning means 15. Furthermore, the photosensitive drum 2 uses amorphous silicon.

A separating means 16 is located at a designated location on the downstream side from the transfer position in the direction of sheet transport. This separating means 16 has separation needles 17. Furthermore, as will be described later, by applying a separation voltage to the separation needles 17, corona discharge will occur between the separation needles 17 and the photosensitive drum 2, and thereby the sheet 12 will have the static charge eliminated and will separate from the photosensitive drum. Furthermore, separation tabs 18 which remove sheets which could not be removed by the separating means 16 are located in the area around the photosensitive drum 2 and between the separating means 16 and the cleaning means 15.

The sheet 12 which had the static charge removed and which was separated from the photosensitive drum 2 by the separating means 16 is then fed to the fixing means 20, and then heat and pressure are applied by the fixing means 20 and the toner is fixed. Furthermore, the sheet fed from the fixing means 20 is discharged to the paper discharge tray 22 by rollers 21 and accumulated on the paper discharge tray 22.

Figure 2:
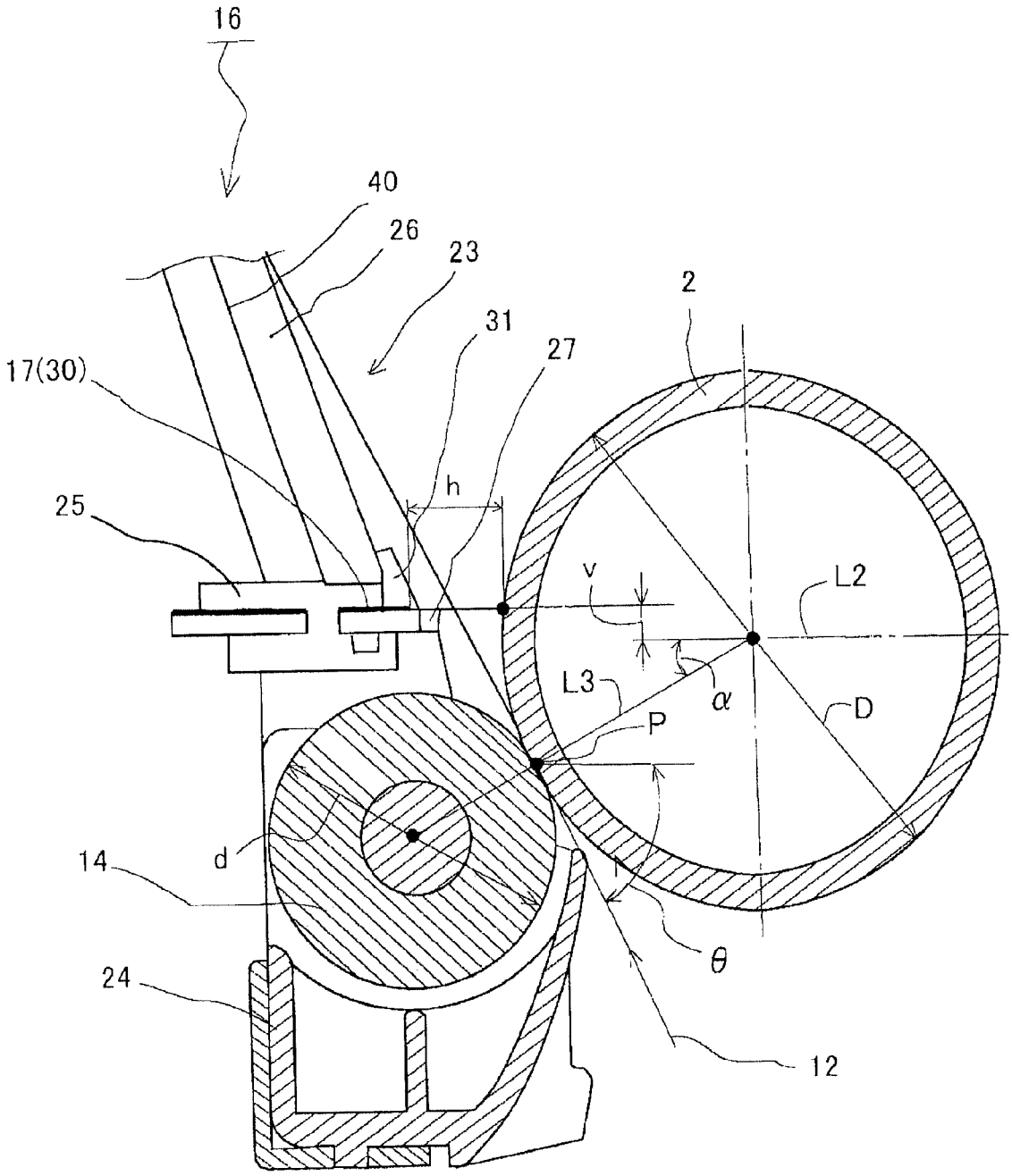
FIG. 2 is a block diagram showing the relationship between the separating means, the photosensitive drum, and the transfer roller.

FIG. 2 shows the details of the separating means 16. As shown in FIG. 2, the separating means 16 is comprising a transfer housing 24 which rotatably supports transfer roller 14, an upstream side wall region 27 located downstream of the transfer housing 24 in the sheet transport direction, and a transport unit 23 which is located downstream from the upstream side wall region 27. Furthermore, a plate like separation electrode unit 30 is supported on the downstream side edge surface of the upstream side wall region 27 in a direction orthogonal to the sheet transport direction. This separation electrode unit 30 is fixed in place between the upstream side wall region 27 and a mounting member 25 by the mounting member 25. Furthermore, the transport unit 23 has a plurality of transport plates arranged at prescribed intervals in a direction orthogonal to the sheet transport direction which guide the transport of the sheet 12, and a grounding plate (conductive member) 40 arranged between the plurality of transport plates 26.

Figure 3:
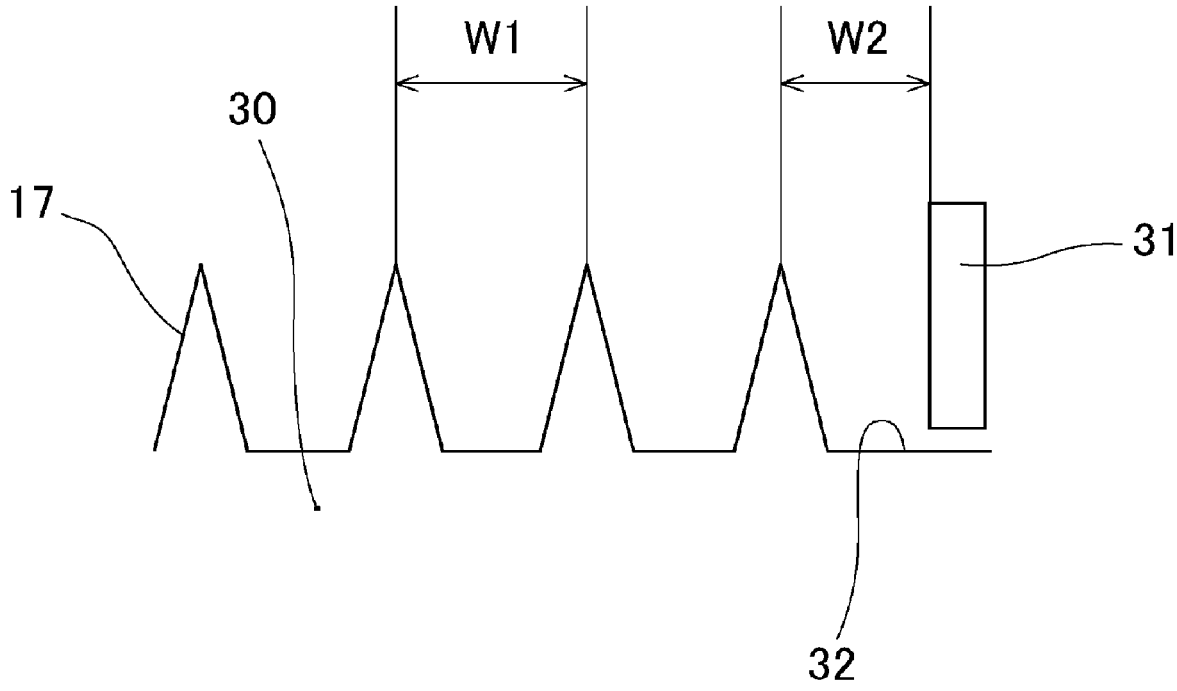
FIG. 3 is a front view of a separation needle.

As shown in FIG. 3, the separation electrode 30 has a plurality of separation needles 17 formed to protrude in the paper transport lateral direction. Cutaway regions 32 between the separation needles 17, 17 in the paper transport lateral direction are formed to engage with ribs 31 which will be described later. Note, the optimal values for dimension W1 between separation needles 17, 17 and dimension W2 in the paper transport lateral direction between the tip of the separation needles 17 and the ribs 31 are determined by tests which are discussed later.

The separation electrode 30 is formed from a conductive material (such as SUS 304 or the like) and has a length at least as long as the paper transport lateral dimension of the largest sheet 12 which will be used for printing. Furthermore, the separation needles 17 have a nearly triangular shape when viewed along the direction of transport (refer to FIG. 3), converge toward the photosensitive drum 2 side, and are formed such that discharging occurs between the tip end thereof and the photosensitive drum 2.

Figure 4:
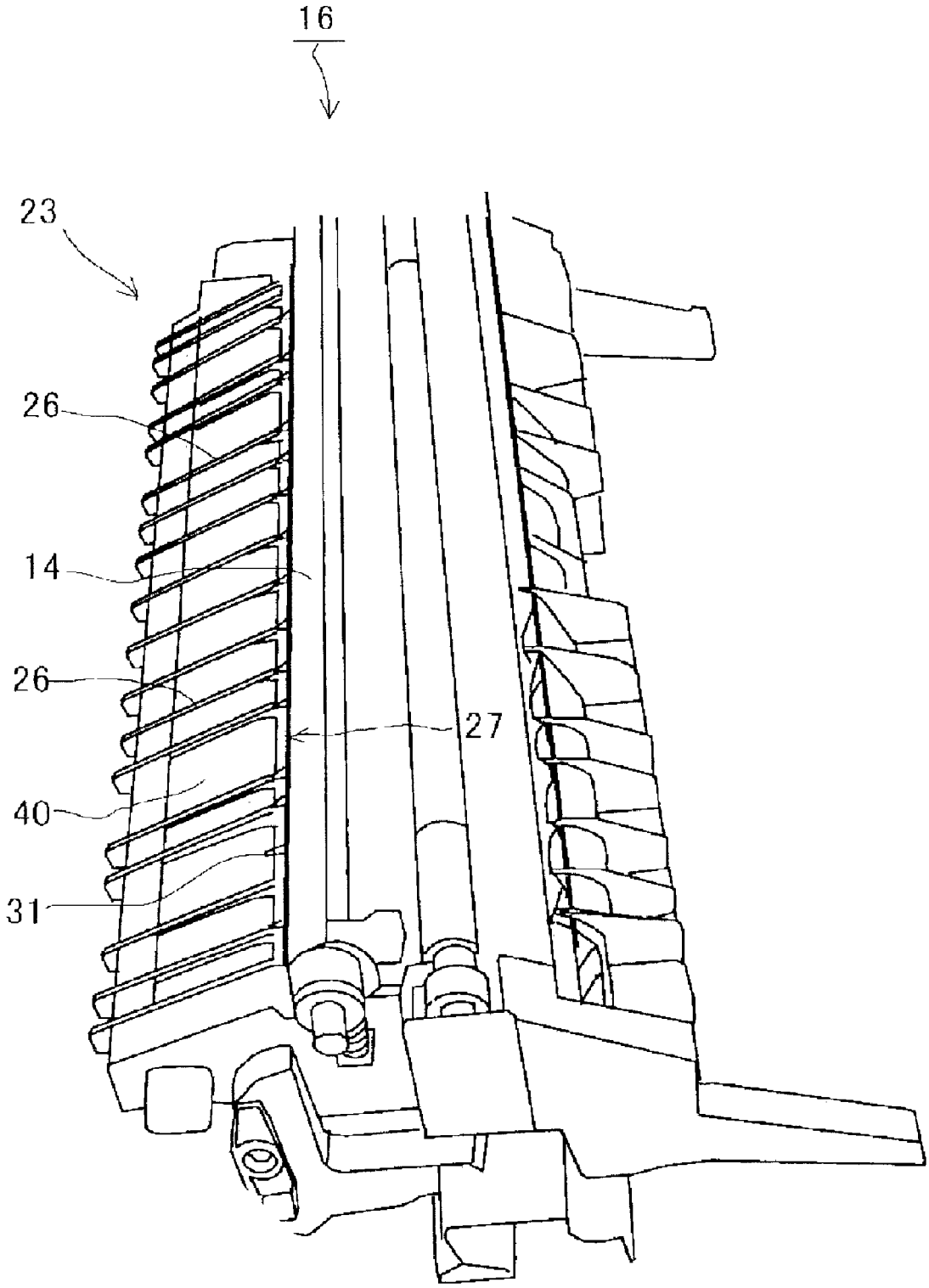
FIG. 4 is a perspective view of the transport unit of the separating means.
Figure 5:
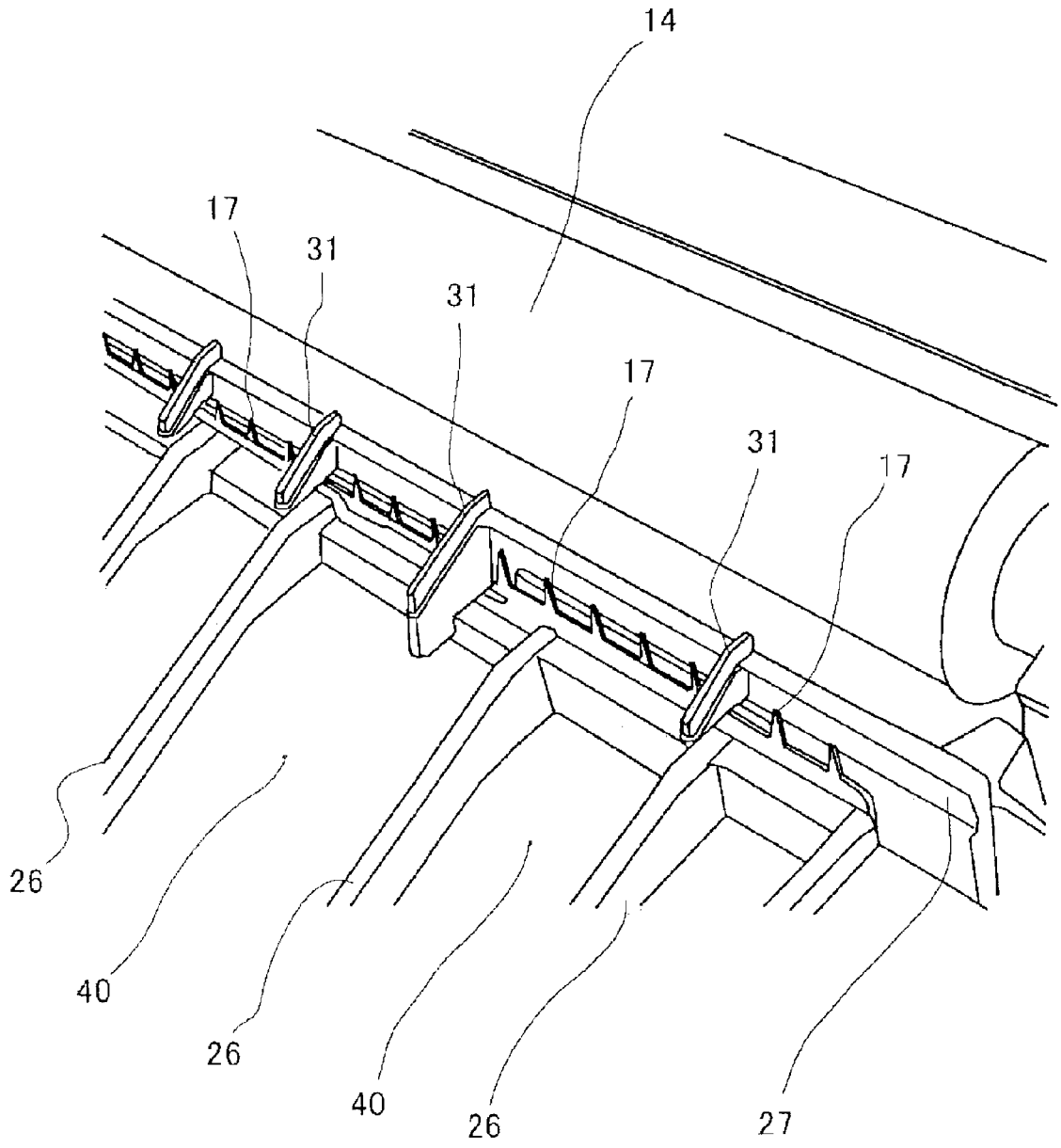
FIG. 5 is an expanded drawing of the major components of the above.

As shown in FIG. 4 and FIG. 5, a plurality of ribs 31 facing in the sheet transport direction are formed along the upstream side wall region 27 in the paper transport lateral direction corresponding to the dimensions in the paper transport lateral direction of the sheet 12 (paper transport lateral dimensions for large size postcards, B5, A4, B4, and A3 or the like). These ribs 31 are arranged corresponding to the sizes of the sheets 12 which are used for printing in order to be able to support sheets 12 of each of the sizes which are transported (used for printing) in order to prevent the sheet 12 from contacting with the separation needles 17.

Furthermore, the plurality of transport plates 26 are arranged in line along the paper transport lateral direction and extend farther to the sheet transport direction downstream side. Furthermore, the aforementioned grounding plate 40 is established between adjacent transport plates 26, and the grounding plate 40 is for instance formed from steel plate (SPCC) or stainless steel plate (SUS 304) or the like. The grounding plate 40 is visible without interference at least from the tip end of the separation needles 17 (the grounding plate is at least exposed to the tip end of the separation needles 17), and is connected to a grounding unit (not shown in the drawings) of the device body. This is to release the static electricity which has accumulated on the sheet 12 after transferring the image, to the grounding plate 40 when the sheet is transported, and because the static electricity that has accumulated on interference will impede corona discharge between the separation needles 17 and photosensitive drum 2 if there is any interference between the separation needles 17 and the grounding plate 40. Therefore, by making the grounding plate 40 visible from the separation needles 17 without interference, corona discharge between the separation needles 17 and the photosensitive drum 2 will easily occur, the discharge efficiency will increase, and the discharge voltage applied to the separation needles 17 can be reduced and discharge consistency improved. Note, if a grounding plate 40 is not provided, the static electricity which accumulates on the sheet 12 cannot be released. Therefore, when fixing the toner image which is formed on the sheet 12, the static electricity will discharge towards the fixing roller, toner will be scattered, and a drop in image quality, referred to as electrostatic scattering, will occur.

Figure 6:
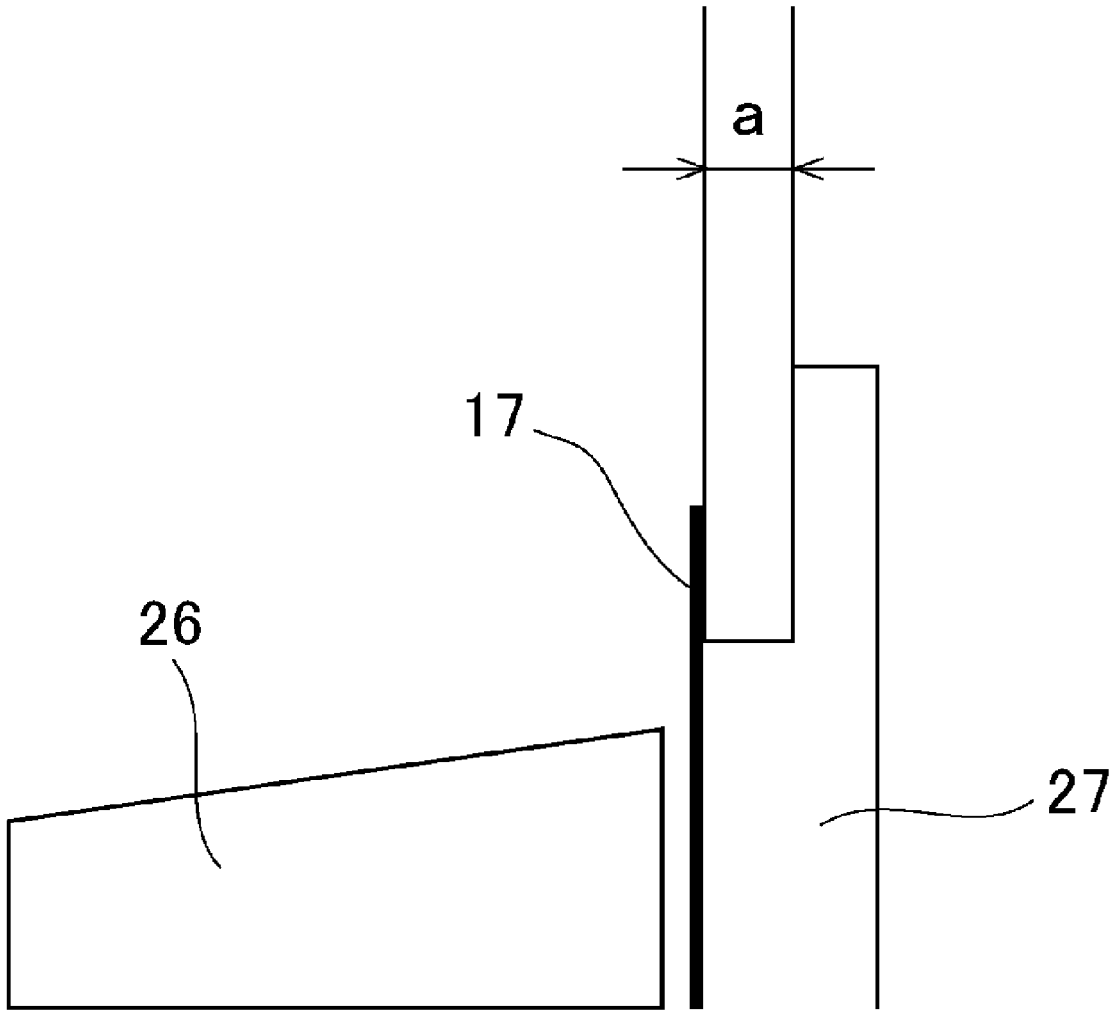
FIG. 6 is a diagram showing the positional relationship between the upstream side wall and the separation needles.
Figure 8:
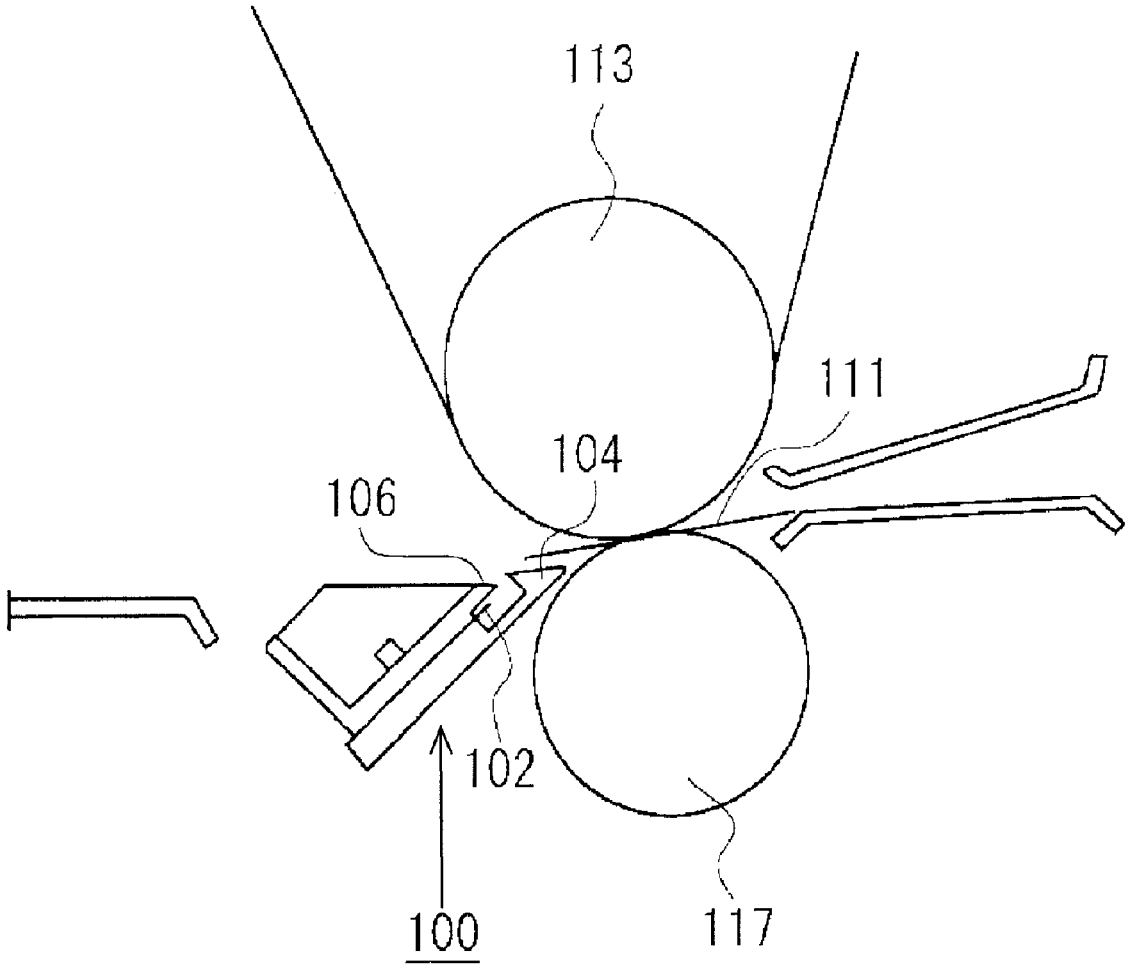
FIG. 8 is a partial block diagram of an image forming device showing a first conventional example.
Figure 9:
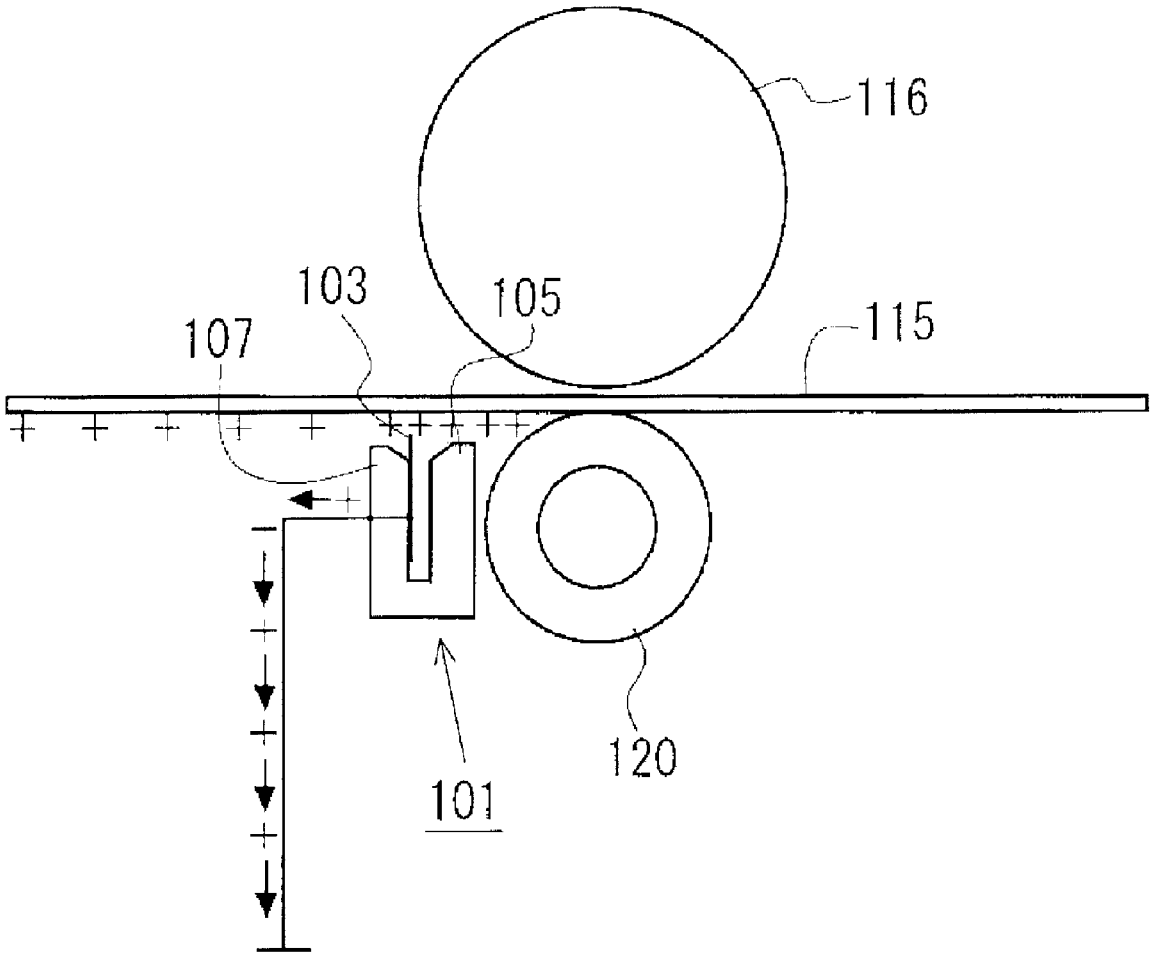
Fig. 9 (Prior Art)
FIG. 9 is a partial block diagram of an image forming device showing a second conventional example.
Figure 10:
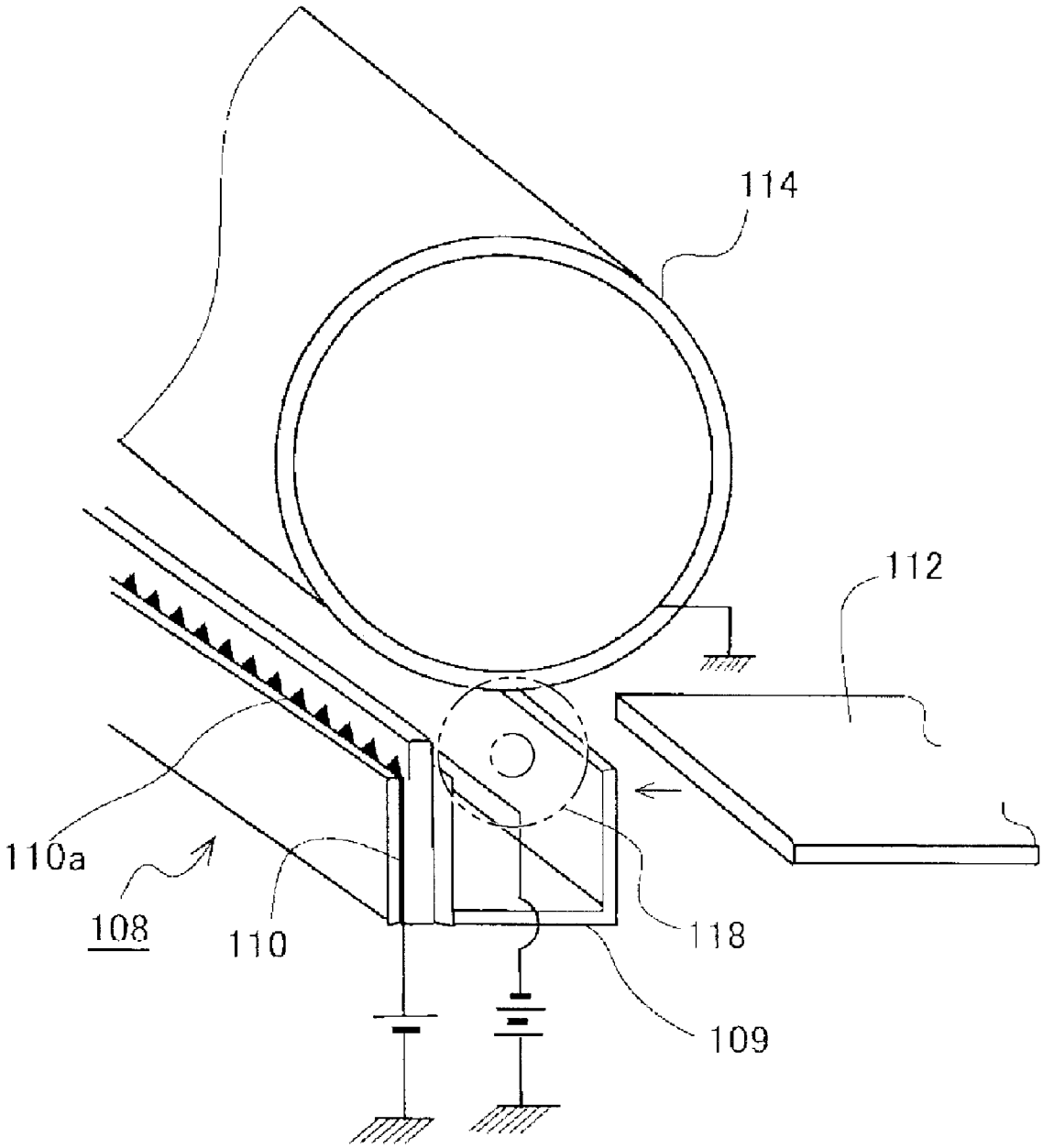
Fig. 10 (Prior Art)
FIG. 10 is a partial block diagram of an image forming device showing a third conventional example.

FIG. 6 is a diagram showing the relationship between the separation needles 17 and the upstream side wall region 27.

In FIG. 6, the minimum distance between the separation needle 17 and the upstream side wall region 27 is expressed as "a" (mm). When fixing a paper jam, the operator inserts his hand between the photosensitive drum 2 and the upstream side wall region 27 and pulls out the sheet 12, but if the distance "a" between the separation needles 17 and the upstream side wall region 27 is too large, there is a possibility that the fingers will be inserted therebetween. Furthermore, the optimum value for this minimum distance "a" is determined by testing which will be discussed later.

Test Results

In these tests, the distance "a" between the separation needles 17 and the upstream side wall region 27 was varied, and the safety when fixing a paper jam was evaluated. Furthermore, a test was performed to evaluate separation of the sheet 12 from the photosensitive drum 2 and dielectric breakdown of the photosensitive drum 2 caused by the discharge voltage, when the dimension W1 between the separation needles 17, 17 and the dimension W2 between the separation needles 17 and the ribs 31 of the upstream side wall region 27 are varied. These measurement results are shown in FIG. 7.

Safety as shown in FIG. 7 was evaluated by determining whether or not the operator's fingers will enter between the separation needle 17 and the upstream side wall region 27 when the sheet 12 was removed when fixing a paper jam, and was determined by the dimension of the minimum distance "a" between the separation needle 17 and the upstream side wall region 27. Furthermore, if fingers would not easily enter between the separation needle 17 and the upstream side wall region 27, an evaluation of "+" was made, but if there was a possibility that fingers could easily enter between the separation needles 17 and the upstream side wall region 27, an evaluation of "−" was made because of the possibility of injuring the operator.

Furthermore, the separation properties shown in FIG. 7 were determined by the transport properties of the sheet 12, and if the copied sheet 12 contacted the separation tabs 18 and the separation tabs 18 left a mark in the toner image which was transferred to the sheet 12, an evaluation of "−" was made because the transferred toner image would be affected. The evaluation was performed by printing 10,000 half page images on sheets 12. Furthermore, with regards to "++" and "+", if the separation tabs 18 did not leave a mark on the toner image which was transferred to the sheet 12, an evaluation of "++" was given if the average minimum distance between the separation tabs 18 and the sheet 12 being transported was 10 mm or less and the sheet 12 did not contact the separation tabs 18, and an evaluation of "+" was given if the average minimum distance between the separation tabs 18 and the sheet 12 being transported was closer than 10 mm, but the sheet 12 did not contact the separation tabs 18. The gap between the separation needles 17 and the sheet 12 was measured for 1000 sheets 12 using a high-speed video. In FIG. 7, an evaluation of "+/−" was given if 10 or fewer sheets 12 had a permissible level of tab marks visible to the naked eye, and an evaluation of "−" was given if a sheet 12 had an unacceptable level of tab marks, or if 11 or more sheets 12 had an permissible level of tab marks. Note, the sheet 12 used for this and other evaluations was a thin paper with a paper weight of 64 g/m$^2$ which was most likely to wrap around the photosensitive drum 2.

Furthermore, the dielectric breakdown shown in FIG. 7 was determined by whether or not the sheet 12 had black dots in the image, which accompanies dielectric breakdown of the protective layer of the photosensitive drum caused by separation, when a text image with a printing ratio of 5% was printed on 500,000 sheets 12. This dielectric breakdown can be prevented by making the separation needle 17 discharge consistent in the paper transport lateral direction. Furthermore, an evaluation of "+" was given if black dots did not occur in the toner image in accordance with the following measurement method, an evaluation of "+/−" was given if there were 5 or fewer black dots on 1 sheet, and an evaluation of "−" was given if six or more black dots occurred. The image black dot measurement method was performed by outputting five sheets 12 without any printing after 500,000 sheets and counting the number of black dots on the sheet 12 using a dot analyzer (Oji Scientific Instruments Co., Ltd. DA-5000S) to evaluate the dielectric breakdown of the photosensitive layer. The measurement range of the number of black dots measured was determined by taking the average of five sheets in a region 210 mm×5 mm in the A4 lateral direction.

Furthermore, the electrostatic scattering shown in FIG. 7 was performed by checking a random sample of 500 sheets during the aforementioned dialectic breakdown test and visually confirming whether or not toner has been scattered around the text field, and an evaluation of "+" was made if no electrostatic scattering was observed, "+/−" if five or fewer sheets 12 were found to have electrostatic scattering, and "−" if more than five sheets 12 were found to have electrostatic scattering.

Note, the amorphous silicon type photosensitive drum 2 used for this embodiment has a protective layer on the surface which also acts as a charge retainer. This photosensitive drum 2 protective layer is approximately 1 μm thick and can withstand a voltage of several hundred volts. Therefore, dielectric breakdown will easily occur and a more precise design is required as compared to organic photosensitive drums with a thick layer. Furthermore, with this type of photosensitive drum 2, when multiple sheets 12 are separated from the photosensitive drum 2, the electrical charge on the surface cannot be retained when the protective layer is broken down by the discharge voltage, so the toner will adhere in this region, unnecessary black dots will appear in the image, and the life of the device will be shortened.

In accordance with FIG. 7, if a grounding plate 40 is established, and the dimension W1 between the separation needles 17, 17 is such that $7 \geqq W1 \geqq 2$, and the minimum distance W2 (mm) between the ribs 31 and the separation needles 17 is such that $4 \geqq W2 \geqq 2$, the evaluation of the separation and the dielectric breakdown will be favorable. Under these conditions, the corona discharge will be consistent even during long-term use, and separation will be favorable without discharge variation occurring. Therefore, the discharge voltage applied to the separation needles 17 can be reduced, and dielectric breakdown will not occur. Furthermore, if the minimum distance a (mm) between the separation needles 17 and the upstream side wall region 27 is such that $1.0 \geqq a \geqq 0.5$, safety will be improved because the operators fingers will not be able to enter between the separating needles 17 and the upstream side wall region 27.

Note, with Comparative Example 1 which does not have a grounding plate 40, the electrical field around the separation needles 17 is unstable even though W1 and W2 are within the aforementioned ranges, and therefore the separation was evaluated as "−". Furthermore, the dielectric breakdown was evaluated as "−" because the electrical field around the separation needles 17 was unstable, and this is thought to lead to locally higher electrical field densities, electrical discharge between the separation needles 17 and the photosensitive drum 2, and dielectric breakdown. Furthermore, an evaluation of "−" was given for electrostatic scattering because the static electricity which accumulated on the sheet 12 during the transfer process and the separation process or the like could not be eliminated.

Furthermore, with Comparative Example 2, a grounding plate 40 was established, but when interference existed between the grounding plate 40 and the tip end of the separation needles 17, the electrical field around the separation needles 17 was unstable, similar to the case where the grounding plate 40 was not established. Therefore, even though W1 and W2 are within the aforementioned ranges, separation and dielectric breakdown were both evaluated as "−". Furthermore, as shown in Comparative Example 3, even though separation needles 17 are used which have values for W1 and W2 which vary slightly from the ranges of $7 \geqq W1 \geqq 2$ and $4 \geqq W2 \geqq 2$, an evaluation of "+/+" was achieved, a level where there is practically no interference. If the values for W1 and W2 are extremely large, such as 15 mm, the electrical field between the separation needles 17 will be weak, and of course this will hinder the separation performance. Furthermore, if W1 and W2 are extremely small, such as 1 mm or less, discharge from the separation needles 17 will be unstable, there is a possibility of dielectric breakdown of the photosensitive drum 2, and the separation needles 17 will be difficult to manufacture.

An embodiment of the present invention will be described with reference to FIG. 2. FIG. 2 shows the construction used for this test. In this embodiment, the diameter D of the amorphous silicon type photosensitive drum 2 was 30 mm, and the diameter d of the transfer roller 14 was 15.75 mm. Furthermore, the transfer roller 14 was shifted approximately 0.2 mm to the photosensitive drum 2 side in order to create a nip region P between the transfer roller 14 and the photosensitive drum 2, and this nip region P was the transfer location. The transfer roller 14 was formed from a material with an electrical resistance of 7.0 (log ohm) and a rubber hardness (ASCA-C) of 35° (such as EPDM formulated with conductive carbon black or the like).

Furthermore, line L3 which connects the axis of rotation of the photosensitive drum 2 and the axis of rotation of the transfer roller 14 forms an angle $\alpha$ of 30° with the horizontal line L2 in FIG. 2, and the angle $\theta$ that sheet 12 enters the nip region P is 60°. Furthermore, the tip end of the separation needles 17 are located such that v=2.29 mm in the vertical direction from the axis of rotation of the photosensitive drum 2, and h=7.43 mm in the horizontal direction from the surface of the photosensitive drum 2.

Furthermore, the linear speed of the photosensitive drum 2 was set to 135 mm/s, the surface electrical potential at the developing position of the photosensitive drum 2 was 250 V, the transfer output was 50 μA (constant current), the separation output applied to the separation needles 17 was 40 μA (constant current), and the voltage was approximately 4.8 kV. Furthermore, the developing bias was set such that a direct current of 150 V was applied along with an alternating current of 1.7 kV at 3 kHz.

Note, all of the values shown in this embodiment are for an example of the present invention, and the present invention is not restricted to these values.

INDUSTRIAL APPLICABILITY

The present invention can be broadly applied to image forming devices such as electrophotographic copiers, printers, fax machines, and combination devices thereof or the like.

Any terms of degree used herein, such as "substantially", "about" and "approximately", mean a reasonable amount of deviation of the modified term such that the end result is not significantly changed. These terms should be construed as including a deviation of at least ±5% of the modified term if this deviation would not negate the meaning of the word it modifies.

This application claims priority to Japanese Patent Application No. 2004-347045. The entire disclosure of Japanese Patent Application No. 2004-347045 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. An image forming device, comprising:

an image supporter being configured to support a toner image and to rotate;

a supply unit being configured to supply sheet like recording media to the image supporter;

transferring means for transferring the toner image of the image supporter to one or more sheet like recording media transported by the supply unit; and separating means having a plurality of separation needles arranged along a direction orthogonal to the medium transport direction located downstream in the medium transport direction from the transferring means, for eliminating static charge from the recording medium by applying a separation voltage to the separation needles, and separating the recording medium from the image supporter, the separating means including a transport unit for transporting the recording medium established downstream in the recording medium transport direction from the separation needles, the transport unit having a plurality of transport plates for guiding the transport of the recording medium and arranged in a direction orthogonal to the recording medium transport direction and a conductive member located between the plurality of transport plates, and the conductive member and a tip end of the separation needles being arranged such that the conductive member is visible without interference from the tip end of the separation needles such that a line of sight from the tip end of the separation needles and the conductive member exists, and the conductive member being connected to a ground.

2. The image forming device according to claim 1, wherein the distance W1 (mm) between the plurality of separation needles is $7 \geqq W1 \geqq 2$, further comprising ribs between the plurality of separation needles for guiding the transport of the recording medium so that the recording medium will not catch on the separation needles, and the minimum distance W2 (mm) between the ribs and the separation needles is $4 \geqq W2 \geqq 2$.

3. The image forming device according to claim 2, wherein the tip end of the ribs are located farther to the image supporter side than the tip end of the image supporter side of the separation needles.

4. The image forming device according to claim 1, wherein the image supporter is formed from amorphous silicon.

5. The image forming device according to claim 4, wherein the image supporter has a protective layer on the surface with charge retaining functions and the thickness of the protective layer is approximately 1 μm.

6. The image forming device according to claim 2, wherein the separating means is located downstream of the transferring means in the recording medium transport direction and has a wall region which extends in a direction orthogonal to the recording medium transport direction, and the separation needles are supported by the wall region.

7. The image forming device according to claim 6, wherein a gap a is formed in the recording medium transport direction, and the gap a (mm) is such that $1.0 \geqq a \geqq 0.5$.

8. The image forming device according to claim 2, wherein the separating needles have a near triangular shape when viewed in the direction of transport, and electrical discharge occurs between the tip ends thereof and the image supporter.

* * * * *